US005580108A

United States Patent [19]

Bergstein

[11] Patent Number: 5,580,108

[45] Date of Patent: Dec. 3, 1996

[54] DOOR SECURITY DEVICE

[76] Inventor: David S. Bergstein, 1121 Turner NE., Albuquerque, N.M. 87123

[21] Appl. No.: 534,732

[22] Filed: Sep. 27, 1995

Related U.S. Application Data

[63] Continuation of Ser. No. 221,842, Apr. 1, 1994, abandoned.

[51] Int. Cl.[6] ..... E05C 19/18

[52] U.S. Cl. ..... 292/259 R

[58] Field of Search ..... 292/259 R, 288, 292/289, 235, 210

[56] References Cited

U.S. PATENT DOCUMENTS

| | | | |
|---|---|---|---|
| 546,164 | 9/1895 | Knight | 292/259 |
| 924,277 | 6/1909 | Saphier | 292/259 R |
| 1,344,444 | 6/1920 | Edman | 292/259 |
| 2,421,275 | 5/1947 | Lopez | 292/259 R |
| 2,843,411 | 7/1958 | Nettleship | 292/278 |
| 3,266,831 | 8/1966 | Banse | 292/235 X |
| 3,433,518 | 3/1969 | Foltz | 292/235 X |
| 3,592,497 | 7/1971 | Logan, Jr. | 292/259 R |
| 3,955,841 | 5/1976 | Walker | 292/259 R |
| 4,079,972 | 3/1978 | Hagopian | 292/259 R |
| 4,082,332 | 4/1978 | Palmer | 292/259 R |
| 4,429,911 | 2/1984 | O'Neal et al. | 292/259 R |
| 4,462,625 | 7/1984 | Barnhill | 292/259 R |
| 4,601,503 | 7/1986 | Wicks, Sr. | 292/259 R |
| 4,602,720 | 7/1986 | Mattsson | 292/259 R X |
| 5,078,438 | 1/1992 | Bieganski | 292/235 |

*Primary Examiner*—Rodney M. Lindsey
*Attorney, Agent, or Firm*—William E. Hein

[57] ABSTRACT

A door security device for preventing forced entry through an exterior door of a residence, for example, includes a steel bar, a top end of which is attached to a swivel connector that is anchored into a vertical stud within the wall framing structure adjacent the opening side of the door, and a quick release latch anchored into a stud within the wall framing structure adjacent the opposite or hinged side of the door. When in use, the steel bar is latched into position diagonally across the inside of the door. When not in use, the steel bar simply hangs from the swivel connector freely and unobtrusively in a vertical position alongside the door.

4 Claims, 1 Drawing Sheet

DOOR SECURITY DEVICE

This application is a continuation of application Ser. No. 08/221,842, filed Apr. 1, 1994, now abandoned.

BACKGROUND AND SUMMARY OF THE INVENTION

This invention relates generally to security systems and more particularly to a door security device for preventing forced entry through exterior doors of residential buildings, for example. The most common prior art device for preventing forced entry through an exterior door of a residence is the deadbolt lock. These locks are mounted on the edge of the door so that the deadbolt engages a recess in the door jamb. These prior art deadbolt locks are disadvantageous and largley ineffective because a male intruder of average size can easily splinter the door jamb with a kick or shove against the door and thereby gain entry into the residence.

It is therefore a principal object of the present invention to provide a door security device that is inexpensive, easy to install and use, and that effectively prevents forced entry through residential doors.

Further objects of the present invention are to provide a door security device that is unobtrusive in appearance when not in use and that may be engaged and disengaged by persons in wheelchairs.

These and other incidental objects are accomplished in accordance with the illustrated preferred embodiment of the present invention by providing a steel bar of circular cross section, a top end of which is attached to a swivel connector that is in turn anchored into a second vertical framing stud of the wall framing structure adjacent the opening side of the door at a position that is above the center of the overall height of the door. The swivel connector includes a raised mounting plate anchored into a vertical framing stud, a shoulder washer positioned over the bar, a pair of collars mounted on the bar on either side of the shoulder Washer for retaining the shoulder washer, and an eye bolt having an eye member positioned over the shoulder washer and a threaded stud member mounted to the mounting plate. A quick release latch anchored into the wall framing structure adjacent the at a position that is below the center of the overall height of the door serves to retain the bottom end of the steel bar. When in use, the steel bar is latched into position diagonally across the inside of the door. When not in use, the steel bar simply hangs unobtrusively in a vertical position along the opening side of the door.

DETAILED DESCRIPTION OF THE PREFERRED EMBODIMENT

Figure 1:
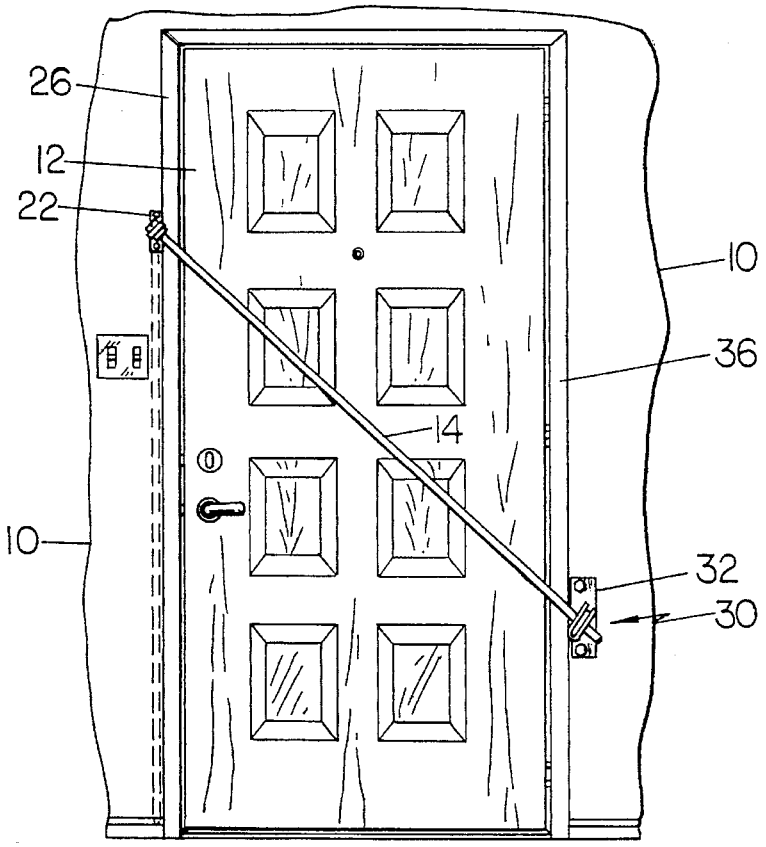
FIG. 1 is an overall pictorial diagram illustrating the way in which the door security device of the present invention is installed and used to protect an exterior residential door, for example, against forced entry.
Figure 3:
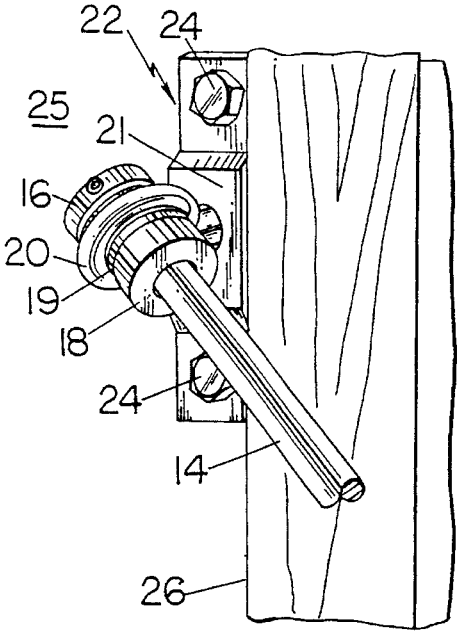
FIG. 3 is a detailed diagram illustrating the way in which a top end of the steel bar of FIG. 2 is attached to a swivel connector that is anchored into the wall framing structure adjacent the opening side of the door.
Figure 2:
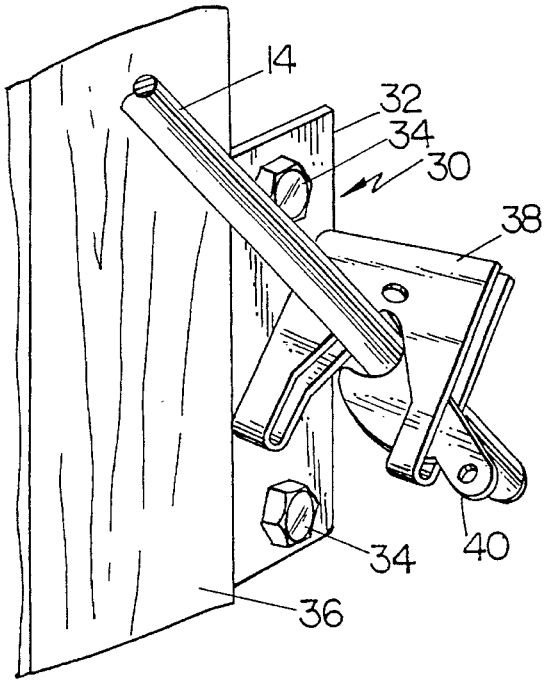
FIG. 2 is a detailed diagram illustrating the way in which a bottom end of a steel bar of the door security device of FIG. 1 is engaged by a quick release latch that is anchored into the wall framing structure adjacent the hinged side of the door.

Referring now to the drawing figures, there is shown the door security device of the present invention installed on an inside wall adjacent a door 12 to be protected against forced entry. A steel bar 14, approximately five feet in length, is fitted with a pair of spaced apart collars 16, 18 at a top end thereof. Collars 16, 18 may be fixedly attached to steel bar 14 by means of one or more set screws, for example. Steel bar 14 may comprise a length of commercially available ½-inch cold rolled steel bar material, for example. A nylon shoulder washer 19 is positioned over steel bar 14 between collars 16, 18. An eye bolt 20 is provided, an eye portion of which is positioned over nylon shoulder washer 19, and a threaded stud portion of which is placed through a hole in a central section 21 of a plate 22. Central section 21 of plate 22 is raised to permit attachment of a lock nut on the threaded stud portion of eye bolt 20. The combination of collars 16 and 18, nylon shoulder washer 19, eye bolt 20, and plate 22 comprises a swivel connector 25 that permits movement of steel bar 14 with respect to plate 22. A pair of bolts 24 are employed to securely attach plate 22 to a vertical stud within the framing structure of wall 10. Plate 22 is bolted to wall 10 at a point approximately two feet below the top of door 12 against an outer edge of a door trim member 26 adjacent the opening side of door 12.

A quick release latch 30 includes a flat plate 32 that is, like plate 22, securely attached to a stud within wall 10 by a pair of bolts 34. Plate 22 is bolted to wall 10 at a point approximately two feet above the bottom of door 12 against an outer edge of a door trim member 36 adjacent the hinged side of door 12. Quick release latch 30 further includes a U-shaped latch member 38 that is fixedly attached to plate 32 by welding, for example. A latch lever 40, hingedly attached within latch member 38 is gravitationally positioned over steel bar 14 to retain steel bar 14 in place within quick release latch 30.

When in use, steel bar 14 is positioned diagonally across the inside of door 12 and latched into place by quick release latch 30. When not in use, steel bar 14 is unlatched from quick release latch 30 and allowed to hang freely and unobtrusively in a vertical position alongside door 12, as illustrated by the dotted lines in FIG. 1. By mounting swivel connector 25 and quick release latch 30 at different heights on either side of door 12, steel bar 14 is positioned diagonally across door 12 when in use. The force resulting from an attemped unauthorized entry is thereby distributed over a larger surface area of door 12 than if steel bar 14 were to be positioned horizontally across door 12, as would result from mounting swivel connector 25 and quick release latch 30 at the same height. An additional benefit realized by mounting quick release latch 30 closer to the bottom of door 12 is that steel bar 14 may be easily latched and unlatched by persons in wheelchairs.

I claim:

1. A door security device mounted inside a door to be protected against forced entry, the door security device comprising:

a swivel connector anchored to a first vertical stud within a wall framing structure adjacent an opening side of said door, said swivel connector being anchored to said first vertical stud at a position that is above the center of the overall height of said door;

a bar having a circular cross section, said bar being connected at one end thereof to said swivel connector to permit arcuate motion of said bar within a plane parallel to a plane of said door;

said swivel connector comprising a raised mounting plate anchored to said first vertical stud, a shoulder washer positioned over said bar, a pair of collars mounted on said bar on either side of said shoulder washer for retaining said shoulder washer, and an eye bolt having an eye member positioned over said shoulder washer and a threaded stud member mounted to said mounting plate; and quick release latch means anchored to a second vertical stud within a wall framing structure adjacent a hinged side of said door, said quick release latch means being anchored to said second vertical stud at a position that is below said center of the overall height of said door, said quick release latch means being operative for releasably retaining a free end of said bar, whereby said bar is permitted to hang in a vertical position from said swivel connector when not in use and is retained in a diagonal position across the inside of said door when in use.

2. A door security device as in claim 1 wherein said bar comprises a length of cold rolled steel of circular cross section.

3. A door security device as in claim 1 wherein said door comprises an entry door of a residence.

4. A method for protecting a door against forced entry, the method comprising:

providing a swivel connector anchored to a first vertical stud within a wall framing structure adjacent an opening side of said door, said swivel connector being anchored to said first vertical stud at a position that is above the center of the overall height of said door;

providing a bar having a circular cross section connected at one end thereof to said swivel connector to permit arcuate motion of said bar within a plane parallel to a plane of said door, said swivel connector comprising a raised mounting plate anchored to said first vertical stud, a shoulder washer positioned over said bar, a pair of collars mounted on said bar on either side of said shoulder washer for retaining said shoulder washer, and an eye bolt having an eye member positioned over said shoulder washer and a threaded stud member mounted to said mounting plate;

providing a quick release latch anchored to a second vertical stud within a wall framing structure adjacent a hinged side of said door, said quick release latch being anchored to said second vertical stud at a position that is below said center of the overall height of said door;

engaging said quick release latch over a free end of said bar such that said bar is retained in a diagonal position across an inside surface of said door when it is desired to protect said door; and disengaging said quick release latch to permit said bar to hang in a vertical position from said swivel connector when it is not desired to protect said door.

* * * * *